United States Patent [19]

Cosby et al.

[11] 4,445,746

[45] May 1, 1984

[54] RESILIENT METAL CONTACT BRUSH

[75] Inventors: Chris Cosby, Leighton Buzzara; Martin Heath, Dunstable, both of England

[73] Assignee: Delco Products Overseas Corporation, Detroit, Mich.

[21] Appl. No.: 435,637

[22] Filed: Oct. 21, 1982

[30] Foreign Application Priority Data

Oct. 27, 1981 [GB] United Kingdom ..... 8132396

[51] Int. Cl.[3] ..... H01R 11/22

[52] U.S. Cl. ..... 339/252 R; 310/248; 29/597

[58] Field of Search ..... 310/248, 249, 251, 228, 310/229, 230, 219, 232, 233, 237, 42, 239, 241, 242, 244, 245, 246, 247; 29/597; 339/5 R, 252 R

[56] References Cited

U.S. PATENT DOCUMENTS

| | | | |
|---|---|---|---|
| 3,234,420 | 2/1966 | Linder | 310/248 |
| 3,475,635 | 10/1969 | Mabuchi | 310/248 |
| 4,119,875 | 10/1978 | Noguchi et al. | 310/248 |
| 4,228,376 | 10/1980 | Mabuchi | 310/248 |
| 4,368,398 | 1/1983 | Mabuchi | 310/248 |

FOREIGN PATENT DOCUMENTS

| | | | |
|---|---|---|---|
| 55-63553 | 5/1980 | Japan | 310/251 |
| 55-48011 | 11/1980 | Japan | 310/248 |
| 1283154 | 7/1972 | United Kingdom | 310/248 UX |
| 1538599 | 1/1979 | United Kingdom | 310/248 |

*Primary Examiner*—R. Skudy

*Attorney, Agent, or Firm*—Robert M. Sigler

[57] ABSTRACT

A resilient metal contact brush for use in an electric motor, which contact brush comprises a strip-like metal member having a contact head protruding substantially normally to the plane of the strip-like member, contact head being an integral portion of the strip-like member and being formed by the juxtaposition of two flat ear-like protrusions formed on the strip-like member adjacent one end thereof.

2 Claims, 3 Drawing Figures

RESILIENT METAL CONTACT BRUSH

This invention relates to resilient metal contact brushes for use in electric motors, in particular to resilient metal contact brushes in control systems in direct current windscreen wiper electric motors for use in motor vehicles.

Windscreen wiper motors for motor vehicles are often provided with a control system built into the gear box portion of the windscreen wiper motor, said control system comprising a series of resilient metal contact brushes which engage a rotary contact member mounted on one of the gears of the motor. These resilient contact brushes form part of the speed control system for the windscreen wiper motor as well as the parking brake system which becomes operable when the windscreen wiper motor is switched off to ensure that the windscreen wiper blades connected to the motor part in the correct position on the windscreen of motor vehicle to which the windscreen wiper motor is attached. A windscreen wiper motor control system of this type is disclosed in British patent specification No. 1,283,154, published Apr. 22, 1971; and FIGS. 2 and 6 of the drawings accompanying the aforesaid patent specification show one such resilient metal contact brush designated by the reference numerals 21, 22. The resilient contact brush shown in the aforesaid drawings comprises a strip-like metal member having at one end thereof a fixing aperture and at the other end thereof a contact head protruding substantially normally to the plane of the strip-like member. This contact head is a separate piece of shaped metal which is riveted into position in an aperture in said other end of the strip-like member.

Resilient metal contact brushes of this construction provide very effective switching contacts for use in electric motor control systems of the type disclosed in British patent specification No. 1,283,154. They do, however, have the disadvantage that the shaped contact head requires fixing to the main body of the contact brush during the production thereof, which procedure increases both the assembly time and the cost of the resilient metal contact brush, particularly where automatic production methods are being used to produce such brushes.

A resilient metal contact brush according to the present invention, for use in controlling an electric motor, which contact brush comprises a strip-like metal member having at one end thereof a fixing aperture and at the other end thereof a contact head protruding substantially normally to the plane of the strip-like member, is characterized in that the contact head is an integral portion of the strip-like member and is formed by the juxtaposition of two flat ear-like protrusions formed on the strip-like member adjacent said other end thereof.

Preferably each ear-like protrusion is initially located at the respective edge of, and in the plane of, said strip-like member and said other end of the strip-like member is deformed adjacent said two ear-like protrusions so that the two ear-like protrusions are bent at right angles to the plane of the strip-like member and into planar contact with one another over substantially the whole of their planar area.

In a preferred embodiment of the invention, each ear-like protrusion has a curved peripheral edge such that the contact head formed by the two juxtaposed ear-like protrusions presents a curved contact surface.

The invention and how it may be performed are hereinafter particularly described with reference to the accompanying drawings, in which.

Figure 1:
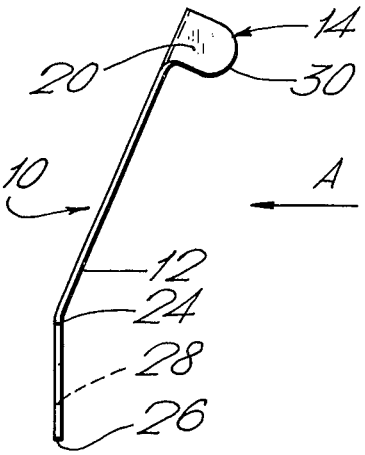
FIG. 1 shows a side view of a resilient metal contact brush according to the present invention.
Figure 2:
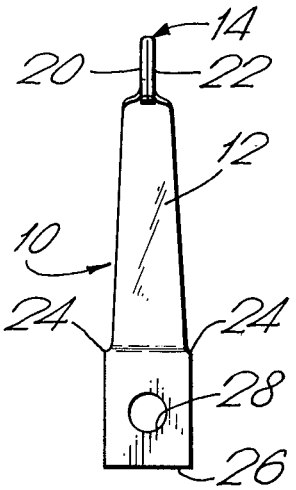
FIG. 2 shows a view of the resilient metal contact brush of FIG. 1 taken in the direction of the arrow A of FIG. 1.

FIGS. 1 and 2 of the accompanying drawings show two views of a resilient metal contact brush 10 according to the present invention, which resilient metal contact brush 10 comprises a strip-like member 12 having a contact head 14 protruding substantially normally to the plane of the strip-like member 12. The contact head 14 is an integral portion of the strip-like member 12 and is produced by deforming an end 16 of a resilient metal blank 18 shown in FIG. 3 of the drawings.

Figure 3:
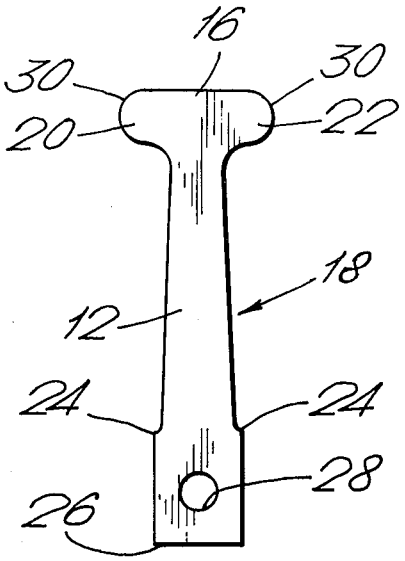
FIG. 3 is a plan view of a resilient metal blank from which the resilient metal contact brush of FIG. 1 is formed.

As can be seen in FIG. 3 of the accompanying drawings, the resilient metal blank 18 has formed at the end 16 thereof two protruding ear-like portions 20, 22 which extend in opposite directions to one another from the end 16 of the blank 18. Each longitudinal edge of the blank 18 is provided with a step-like portion 24 towards the other end 26 of the blank, and there is an aperture 28 formed in the blank 18 adjacent said other end 26, which aperture 28 serves as a fixing aperture for the resilient metal contact brush formed from the metal blank 18.

The resilient metal contact brush 10 shown in FIGS. 1 and 2 of the drawings is formed from the blank 18 shown in FIG. 3 of the drawings by deforming the end 16 of the metal blank 18 so that the two protruding ear-like portions 20, 22 are placed into juxtaposition with one another to form the contact head 14 extending substantially normally to the plane of the strip-like member 12. As can be seen in FIGS. 1 and 3, each of the ear-like portions 20, 22 is provided with a curved peripheral edge 30 such that the contact head formed by the two juxtaposed ear-like protrusions 20, 22 presents a curved contact surface when used in a windscreen wiper motor control system referred to hereinbefore.

Finally, the metal blank 18 shown in FIG. 3 is bent across a line extending between the two step-like portions 24 (shown as a dotted line in FIG. 3) to form the resilient metal contact brush 10 shown in FIGS. 1 and 2. This bending process on the metal blank 18 results in the section of the metal contact brush 10 including the contact head 14 taking up a predetermined angle to the portion of the contact brush 10 which includes the fixing aperture 28. This, in turn, ensures that the curved contact surface of the contact head 18 is pressed with sufficient resilient force against the associated contact in the windscreen wiper motor control system as aforesaid in order to achieve effective transmission of electrical current between the contacts concerned.

A resilient metal contact brush according to the present invention represents a simple yet effective contact brush for windscreen wiper motor control systems, which brush can be manufactured rapidly and economically by automatic machinery. Moreover, a resilient metal contact brush according to the present invention has the advantage over known bent metal contact brushes in that there is substantially no risk of a portion of the brush becoming detached during wear and consequently fouling the moving components of the windscreen wiper motor assembly in which the brush is used.

The resilient metal contact brush may be made from hard phosphor bronze, although it is not restricted to this material.

The embodiments of the invention in which an exclusive property or privilege is claimed are defined as follows:

1. A resilient metal contact brush for use in an electric motor, which contact brush comprises a strip-like metal member having at one end thereof a fixing aperture and at the other end thereof a contact head protruding substantially normally to the plane of the strip-like member, said contact head comprising two flat ear-like protrusions integral with the strip-like member adjacent said other end thereof, said ear-like protrusions further projecting at right angles to the plane of the strip-like member and being in planar contact with one another of substantially the whole of their planar area.

2. A resilient metal contact brush according to claim 1, said ear-like protrusions further having curved peripheral edges such that the contact head formed by the two ear-like protrusions presents a curved contact surface.

* * * * *